United States Patent [19]

Pochon et al.

[11] Patent Number: 4,580,323

[45] Date of Patent: Apr. 8, 1986

[54] STAND ROLLER ASSEMBLY FOR A TORSIONLESS FINISHING BLOCK OF A CONTINUOUS WIRE ROLLING MILL

[75] Inventors: Claude Pochon, Rosselange; Patrick Malard, Auboué ; Henri Biancalana, Homecourt, all of France

[73] Assignee: Sacilor, Societe Anonyme, Hayange, France

[21] Appl. No.: 597,099

[22] Filed: Apr. 5, 1984

[30] Foreign Application Priority Data

Apr. 5, 1983 [FR] France ..... 83 05530

[51] Int. Cl.[4] ..... B21B 13/02

[52] U.S. Cl. ..... 29/116 R; 29/132; 72/237

[58] Field of Search ..... 29/116 AD, 116 R, 113 AD, 29/113 R, 110, 132, 123, 148.4 D, 125, 149.5 R, 148.4 B; 308/DIG. 11; 384/385; 72/257; 226/190, 194

[56] References Cited

U.S. PATENT DOCUMENTS

| | | | |
|---|---|---|---|
| Re. 24,687 | 8/1959 | Swanson | 29/116 R X |
| 3,688,370 | 9/1972 | Cahill et al. | 29/116 R |
| 4,274,185 | 6/1981 | Mifune et al. | 29/125 |

FOREIGN PATENT DOCUMENTS

| | | | |
|---|---|---|---|
| 828133 | 3/1938 | France | 29/148.4 A |
| 1549270 | 11/1968 | France . | |
| 1578543 | 7/1969 | France . | |
| 2409098 | 11/1978 | France . | |
| 1233734 | 5/1971 | United Kingdom . | |

*Primary Examiner*—Howard N. Goldberg
*Assistant Examiner*—Timothy V. Eley
*Attorney, Agent, or Firm*—Laubscher & Laubscher

[57] ABSTRACT

A roller assembly for a stand of a torsionless finishing block of a multi-stand rolling mill for producing continuous wire from a round elongated rod is disclosed. The assembly is characterized by the provision of at least one bearing mounted on the drive shaft between the rollers and the drive shaft of the stand, whereby the stand is operable to calibrate the finished wire. Alignment devices are provided for longitudinally centering the bearing relative to the stand roller and circlips connect the bearing with the roller in the centered position. Spacing elements are mounted on the drive shaft at opposite ends of the bearing to longitudinally position the bearing relative to the shaft. In the absence of a finished wire to be calibrated, the rollers are driven at the speed of rotation of the drive shaft. When finished wire enters the stand and comes in contact with the rollers, the rollers rotate at the speed of rotation of the wire.

9 Claims, 1 Drawing Figure

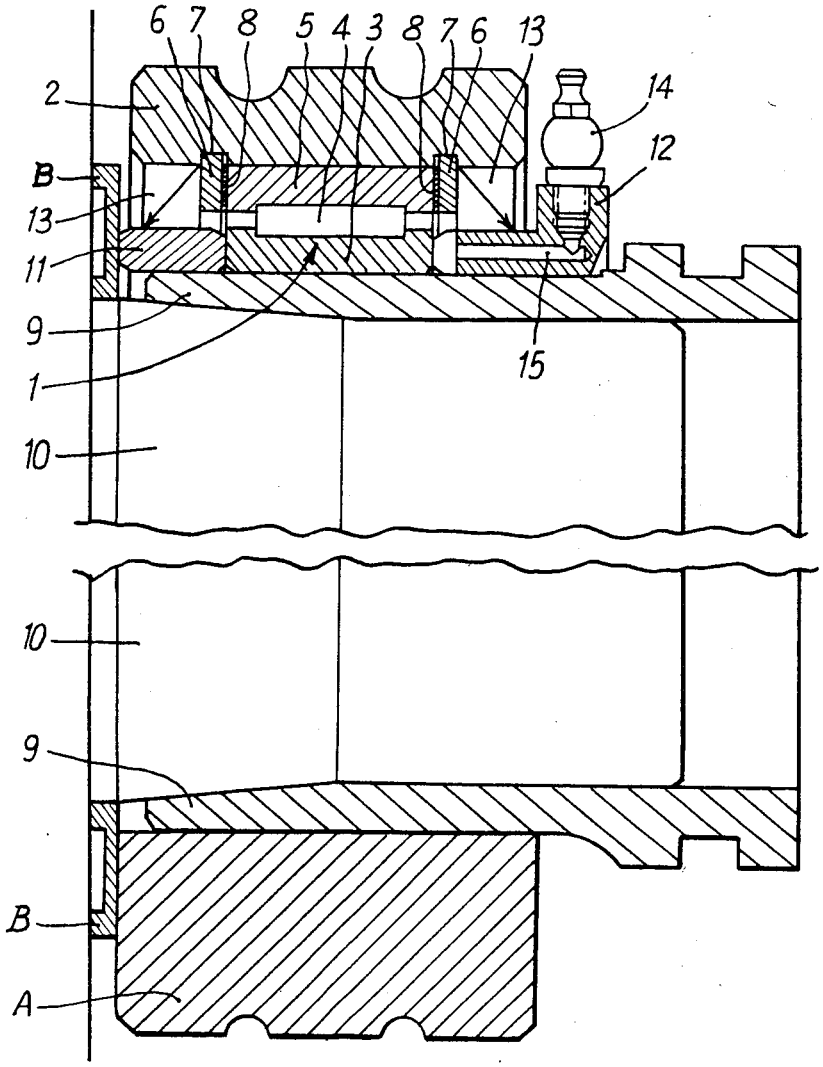
6
7
8
5
4
3
8
7
6
13
14
12
2
B
13
11
9
1
10
15
10
9
B
A

STAND ROLLER ASSEMBLY FOR A TORSIONLESS FINISHING BLOCK OF A CONTINUOUS WIRE ROLLING MILL

BACKGROUND OF THE INVENTION

The present invention relates to rolling mills for continuously rolling round elongated rods into wire, and more particularly, to finishing blocks of the torsionless type for finishing the rolled wire.

A torsionless finishing block generally comprises eight or ten rolling stands, with each stand being shifted 90° with respect to the next succeeding stand. The rollers of each stand are normally mounted in a cantilevered fashion at the end of the roller shafts.

In such a finishing block, the rollers of the stands are driven by a common transmission device at rotational speeds which increase at a fixed ratio between successive stands in the downstream rolling direction. The speed ratio is selected in accordance with the range of cross-sectional sizes of wire or rods being produced. When an attempt is made to increase the range of wire sizes produced beyond the maximum for which the rolling mill was designed, it becomes extremely difficult, if not impossible, to produce larger strands of wire with the required shape and within the required dimensional tolerances using the same mill.

Rather, oversized wire rolled in a mill having a limited size range contains certain imperfections in terms of shape, such as beading and excess metal resulting from intermediate stands, and in terms of dimension. These imperfections, which are not correctable by the stands of the finishing blocks, result in lower grade wire or rejected wire which in turn results in expensive and unprofitable production. On the other hand, with conventional multi-line rolling mills, it is not possible to produce wire with tolerances more restrictive than those for which the mill was designed without expensive modifications of existing equipment.

BRIEF DESCRIPTION OF THE PRIOR ART

It is known in the prior art to add a calibration stand having idler rollers following the finishing stand of a rolling mill which produces successive round metal rods or wires. The calibration stand provides a slight reduction (i.e. a reduction of approximately 1%) to the wires to correct any imperfections in the shape or dimensions of the wire exiting the finishing stand. The idler calibration stand normally comprises a pair of idler rollers mounted on roller bearings as disclosed in *Rollers and Roller Calibration* by Wilhelm Tater, Fr. Wilh. Ruhfus, Publishers, Dortmund, 1921 at pages 117–119 and table V. One drawback with the addition of a calibration stand to correct imperfections in roller wire is the requirement of an additional stand for the rolling mill which greatly increases the cost of the mill. Furthermore, the additional stand is not easily placed within or after the finishing block of a rolling mill. A further drawback of the additional calibration stand results from the provision of the idler rollers which are immobile at the time the rolled wire enters the calibration stand. With the rolling mills of sixty years ago when the calibration stand was introduced, the rolling speeds were relatively low, whereby the introduction of the rolled wire into the idle calibration stand would result in little disruption to the rolling process. With conventional rolling mills, however, having rolling speeds between 70 and 90 meters per second, the entry of wire moving at such a rate into a calibration stand having normally stationary rollers increases the risk of a serious rolling accident.

A similar proposal for correcting imperfections in a rolled wire is disclosed in French Pat. No. 1,549,270 dated Aug. 22, 1967 wherein an additional calibration stand comprising at least four idle rollers is provided to a rolling mill. Finally, French Pat. No. 1,578,543 dated Aug. 23, 1968 discloses a variation of the calibration stand proposed in the earlier French Pat. No. 1,549,270. This variation relates to a special rolling mill including several calibration stands. In this special rolling mill, the stands, beginning with the second stand, are driven by a free-wheel clutch. The first stand is continuously driven and functions as an additional finishing stand. The drawback of this solution is that it is not easily adaptable to existing wire rolling mills, thereby greatly increasing the cost of existing or new rolling mills.

The present invention was developed in order to overcome these and other drawbacks of prior calibration devices for rolling mills by providing at least one calibration pass for rolled wire in at least one existing stand of a torsionless finishing block, without changing the design of the finishing block and the current manner in which the stands of the finishing block are driven.

SUMMARY OF THE INVENTION

Accordingly, it is a primary object of the present invention to provide an improved roller assembly for a stand of the torsionless finishing block of a multi-stand rolling mill for producing continuous wire from a round elongated rod. The roller assembly includes a roller drive shaft adapted for rotation about a longitudinal axis and at least one roller having a longitudinal axis for continuously rolling a length of wire from the round elongated rod. At least one bearing is mounted on the drive shaft and arranged between the drive shaft and the roller. The bearing is longitudinally centered relative to the roller and is connected therewith. Spacing elements are provided to longitudinally position the bearing relative to the drive shaft when the bearing is mounted thereon. With the improved roller assembly, the roller is driven at the speed of rotation of the drive shaft in the absence of a wire to be finished, and at the speed of rotation of the wire when the wire enters the stand for finishing.

According to a more specific object of the invention, the roller has an inner surface adjacent the bearing which contains a pair of circular grooves adapted to receive a pair of circlips for connecting the roller with the bearing.

It is a further object of the invention to provide a pair of annular chocks at opposite ends of the bearing to center the bearing relative to the roller.

According to another object of the invention, the spacing elements have an annular configuration and are arranged adjacent the opposite ends of the bearing.

It is yet another object of the invention to provide a pair of annular seals between the roller and the shaft to prevent dust and other contaminants from contacting the bearing.

According to a further object of the invention, one of the spacing elements contains a through-bore for delivering a lubricant to the bearing.

BRIEF DESCRIPTION OF THE FIGURE

Other objects and advantages of the present invention will become apparent from a study from the following specification when viewed in the light of the accompanying drawing. In the sole FIGURE of the drawing, a cross-section of the roller assembly according to the present invention is shown in comparison with a conventional roller mounting assembly of a finishing stand of the prior art.

DETAILED DESCRIPTION

In the finishing block of a wire rolling mill comprising a plurality of stands driven by a common transmission device, only a portion of the stands are used for finishing and calibration of the finished rolled wire is performed by running it through at least one of the extra stands downstream from the finishing stand. Preferably, the calibration run is performed by the stand immediately following (i.e. immediately down line from) the stand of the block used as a finishing stand.

In order to transform at least one of the stands of a finishing block into an idle calibration stand, the assembly of the rollers of the stand is modified in accordance with the present invention to make the rollers idle without altering the transmission drive mechanism of the roller drive shaft.

Referring to the lower portion of the figure, the conventional assembly of a roller A of the stand of a finishing block is shown. More particularly, the roller A is mounted on a drive shaft 10 adapted for rotation about a longitudinal axis by a force fit bushing 9 to define a unitary roller assembly. The roller is fixed to the shaft owing to frictional contact between the roller A, the bushing 9, and the shaft 10 resulting from the flared or conical projection portions of the shaft and bushing. Furthermore, the roller A, which is longitudinally positioned on the shaft 10 by wedging against a friction disk B, may be locked on the shaft by means of a screw and peg assembly (not shown). Is is apparent that the roller rotates with and at the same speed as the drive shaft.

In accordance with the roller assembly of the present invention, a bearing such as a roller bearing or a ball bearing is interposed between the rollers and the drive shaft of at least one stand of a finishing block, in order to provide a calibration run for finished wire.

In the preferred form of the invention shown in the upper half of the figure, a bearing 1 having a cylindrical roller 4 is arranged between the drive shaft 10 adapted for rotation about a longitudinal axis and the two rollers 2 (of which only one is shown) of a calibration stand.

The bearing 1 includes an inner ring 3, cylindrical rollers 4, and an outer ring 5, with the cylindrical rollers 4 affording relative movement between the inner and outer rings in a conventional manner. The stand rollers 2 each include inner surfaces adjacent the outer ring 5 of the bearing. Each roller inner surface contains a pair of spaced circular grooves 7 each of which is adapted to receive a circlip 6 for connecting the bearing outer ring 5 with the stand rollers 2. As shown in the drawing, the circlips 6 are arranged at opposite ends of the outer ring 5 of the bearing. A pair of annular chocks 8 are arranged between the lateral inner surfaces of the circlips 6 and the lateral outer surfaces of the bearing outer ring 5 for aligning the bearing 1 relative to the stand rollers 2. More particularly, the annular chocks 8 longitudinally center the bearing 1 relative to the stand rollers. The entire bearing/roller assembly is mounted by means of the bearing inner ring 3 on a bushing 9 which in turn is mounted on the roller drive shaft 10 in a conventional manner.

Two annular spacing elements 11, 12 are mounted on the bushing 9 on either side of the bearing 1 with the inner lateral surfaces of the spacing elements being in contiguous abutting relation with the outer lateral surfaces of the opposite ends of the bearing inner ring 3. The lateral outer surface of one of the spacing elements 11 abuts against the friction disk B. In this fashion, the spacing elements insure the longitudinal positioning of the rollers 2 via the bearings 1 relative to the drive shaft 10.

A pair of annular seals 13 is arranged at opposite ends of the bearing in the space between the inner surface of the roller 2 and the associated spacing element adjacent the outer lateral surface of the circlips 6, respectively. The seals prevent dust and other outside contaminants from coming in contact with the bearing.

A grease fitting 14 is provided on the spacing element 12 which contains a through-bore 15, whereby grease or another suitable lubricant can be delivered to the bearing 1.

As a result of the improved roller mounting assembly, the stand rollers are driven at the same speed as the shaft owing to the friction between the rollers, the bearing, and the shaft, when no finished wire is present at the calibration stand. With the rollers moving at the same speed of rotation as the drive shaft, there is no shocking impact when the finished wire enters the stand since the stand rollers are moving at a speed close to the speed of the finished wire or rod. When the stand is under load, i.e. when a strand of wire or rod is being calibrated, the rollers function as idler rollers, owing to the provision of the bearings, and rotate at the linear speed of the wire.

With the improved roller assembly of the present invention, a number of beneficial rolling results may be obtained with only the minimal costs of providing the appropriate number of idler rollers in an existing finishing stand.

More particularly, the dimensional range of round products such as wire or elongated rods produced by the rolling mill can be extended while reducing rounds within strict tolerances.

These results are obtained without loss of time during the change of rolling schedules since the assembly and disassembly of idle rollers according to the present invention is accomplished in the same manner and as rapidly as is accomplished with conventional rollers.

While in accordance with the provisions of the Patent Statutes the preferred forms and embodiments of the invention have been illustrated and described, it will be apparent to those skilled in the art that various changes and modifications may be made without deviating from the inventive concepts set forth above.

What is claimed is:

1. In a multi-stand rolling mill for producing continuous wire from a round elongated rod, a roller assembly for a calibration stand arranged downstream from the stands of a torsionless wire finishing block of stands, comprising (a) generally cylindrical roller drive shaft means adapted for rotation about a longitudinal axis;

(b) at least one roller having a longitudinal axis for continuously rolling and calibrating the wire produced by the finishing block of stands;

(c) bearing means arranged between said roller and said drive shaft means, said bearing means being mounting on said drive shaft means;

(d) means for aligning said bearing means relative to said roller, whereby said bearing means is longitudinally centered relative to said roller;

(e) means for connecting said bearing means with said roller in the centered position; and (f) means for longitudinally positioning said bearing means relative to said drive shaft means, whereby in the absence of finished wire to be roller, said roller is driven at the speed of rotation of said drive shaft, and when rolling finished wire, said roller rotates at the speed of rotation of the wire.

2. Apparatus as defined in claim 1, wherein said bearing means comprises roller bearings.

3. Apparatus as defined in claim 1, wherein said bearing means comprises ball bearings.

4. Apparatus as defined in claim 1, wherein said roller includes an inner surface adjacent said bearing means, said inner surface containing a pair of circular grooves and further wherein said bearing connecting means comprises a pair of circlips arranged at opposite ends of said bearing means and arranged within said pair of grooves, respectively.

5. Apparatus as defined in claim 4, wherein said bearing means includes lateral outer surfaces, and further wherein said bearing aligning means comprises a pair of annular chocks arranged between the lateral outer surfaces of said bearing means and the inner surfaces of said circlips, respectively.

6. Apparatus as defined in claim 5, wherein said longitudinal positioning means comprises a pair of annular spacer elements arranged adjacent the lateral end surfaces of said bearing means.

7. Apparatus as defined in claim 6, wherein said bearing means includes an inner ring adjacent said drive shaft means and an outer ring adjacent said roller means, said annular chocks being arranged adjacent the opposite ends of said outer ring, respectively, and said spacer elements being arranged adjacent the opposite ends of said inner ring, respectively.

8. Apparatus as defined in claim 6, and further comprising a pair of annular seals arranged between the inner surface of said roller and said spacer elements adjacent the outer surfaces of said circlips, respectively, whereby dust is prevented from contacting said bearing means.

9. Apparatus as defined in claim 8, wherein one of said spacer elements contains a through-bore for delivering lubricant to said bearing means.

* * * * *